United States Patent [19]

Hardy

[11] 4,452,477

[45] Jun. 5, 1984

[54] MANIPULATABLE IMPLEMENT

[76] Inventor: Duane S. Hardy, 32 E. Riding Dr., Carlisle, Mass. 01741

[21] Appl. No.: 521,092

[22] Filed: Aug. 8, 1983

[51] Int. Cl.[3] ..... A47G 21/10; B25B 9/00

[52] U.S. Cl. ..... 294/16; 294/1 R; 294/116

[58] Field of Search ..... 294/1 R, 8.5, 11, 16, 294/19 R, 27 R, 33, 86 R, 99 R, 100, 106, 116; D7/102, 105, 137, 138; 30/142, 147, 150, 322, 324; 81/43; 128/321, 325, 354

[56] References Cited

U.S. PATENT DOCUMENTS

| | | | |
|---|---|---|---|
| 809,244 | 1/1906 | Blomquist | 294/8.5 |
| 892,008 | 6/1908 | Porter | 294/8.5 |
| 1,049,259 | 12/1912 | O'Connor | 294/8.5 |
| 1,902,685 | 3/1933 | Baldwin | 294/11 |
| 2,184,074 | 12/1939 | Gent | 294/100 |
| 2,532,406 | 12/1950 | Jernigan | 294/33 X |
| 2,561,374 | 7/1951 | Igoe | 30/324 |
| 2,607,988 | 8/1952 | Williams | 30/322 |
| 2,752,625 | 7/1956 | Ponsell | 294/100 X |
| 2,835,971 | 5/1958 | Neuman | 30/322 |
| 2,839,830 | 6/1958 | Neiman, Jr. | 30/322 |
| 3,141,695 | 7/1964 | Furber | 294/16 |
| 3,186,749 | 6/1965 | Dawes | 294/16 |
| 3,481,037 | 12/1969 | Fenerli | 30/322 |
| 4,199,180 | 4/1980 | Kelly | 294/16 X |
| 4,338,721 | 7/1982 | Cauchon et al. | 30/322 |

*Primary Examiner*—Johnny D. Cherry

*Attorney, Agent, or Firm*—Walter F. Wessendorf, Jr.

[57] ABSTRACT

Disclosed is a manipulatable implement for clamping upon an object or for picking up and holding food. The implement comprises a cylinder halved by a common division running through its center axis at a constant slope for its entire length with such division therethrough being at a rotation of 180 degrees and following the contour of a double helix. Appropriate applied manipulative sliding pressure cams open and closes the two halves to allow their distal ends to clamp upon an object, or to pick up and hold food. A modification has the two halves hinged together in their upper region by a rubber band engaged with a peripheral recess.

5 Claims, 3 Drawing Figures

MANIPULATABLE IMPLEMENT

BACKGROUND OF THE INVENTION

1. Technical Field

This invention relates to a human or robotic, hand manipulatable implement having relatively movable work engaging surfaces to function as a hemostat, forceps, tweezers, to clamp upon or pick up small objects, or to function as an eating utensil.

2. Background

An eating utensil commonly referred to as "chopsticks" comprises two elongated cylindrical objects whose distal ends are utilized to pick up and hold food by relative opening and then closing movements of such distal ends. In operative use, the upper regions of the chopsticks are held and manipulated by the index and middle fingers and thumb of one hand with slight pressure applied along with transmitted hinging movement from such upper regions to cause the distal ends to open and close. Considerable manipulative skill is required to operate a pair of chopsticks.

Since the contacting surfaces of the distal ends of the chopsticks are essentially point contacts, it is difficult to pick up and hold food via frictional contact for the reason that the surface area of frictional contact is minimal.

Accordingly, an object of the invention is to contribute to the solution of the discussed problems of the prior art by providing a manipulatable implement for use as an eating utensil that comprises one cylinder that is halved, requires little manipulative skill to operate and has considerable surface area for frictional or engaging contact in picking up and holding food.

SUMMARY OF THE INVENTION

In accordance with the invention, there is provided a manipulatable implement, made of wood or other suitable material, that has two halves which, when assembled, form one cylindrical object. Such cylinder is halved into two separate parts by a division which runs through its center axis, from end to end. The division spirals or rotates through its center axis at a constant slope for its entire length with such division following the contour of a double helix. Such construction not only permits the manipulatable implement to be operated with little manual skill, but also provides considerable surface area for frictional and engaging contact in clamping upon or picking up small objects, or in picking up and holding food.

BRIEF DESCRIPTION OF THE DRAWINGS

This object and other objects of the invention should be discerned and appreciated by reference to the drawings, wherein like reference numerals refer to similar parts throughout the several views, in which.

DESCRIPTION OF THE PREFERRED EMBODIMENT

Figure 2:
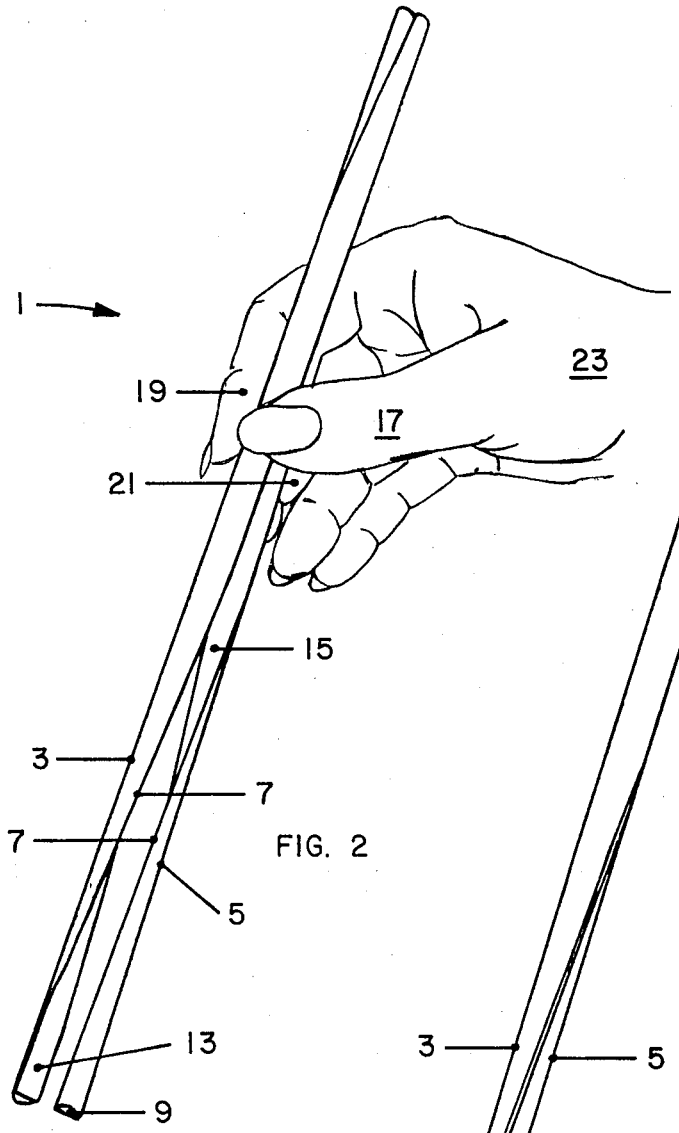
FIG. 2 is another view of the manipulatable implement.
Figure 1:
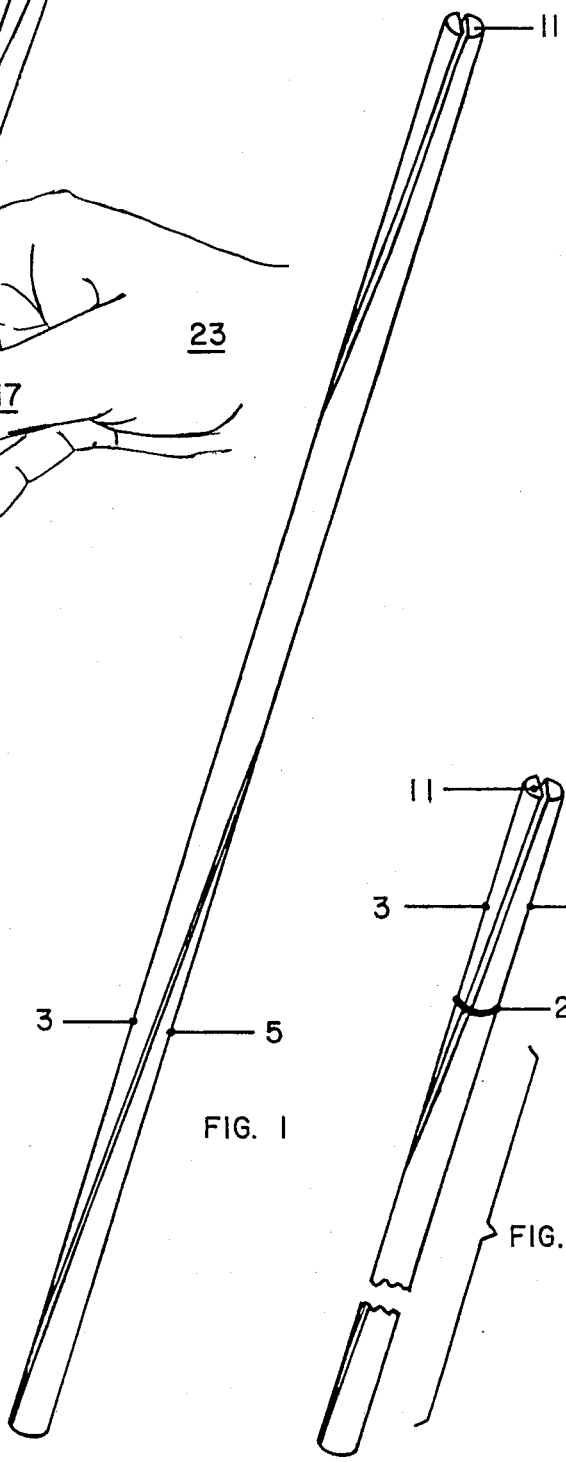
FIG. 1 is a view of the invention and shows the manipulatable implement being manipulated by a human operator.

In FIG. 1 of the drawings, reference numeral 1 generally refers to the manipulatable implement invention which comprises a cylinder that is halved into two separate parts 3 and 5 by a common division 7 which runs through its center axis, from distal end 9 to proximal end 11, and forms thereby inside surfaces 13 and 15, respectively. Such division 7 spirals through the center axis at a constant slope for its entire length and follows the contour of a double helix.

The two parts 3 and 5, when assembled, define a cylinder that is approximately 11 inches long and ⅜ of an inch in diameter. The spiraling division 7 shown has a rotation of approximately 180 degrees from distal end 9 to proximal end 11.

The two halves 3 and 5 are shown held in the upper region approximately 4 inches from the proximal end 11 between the thumb 17 and index and middle fingers 19 and 21 of the right hand 23; however, the two halves 3 and 5 can be held between the thumb and any two fingers of one hand.

The two halves 3 and 5 are easily manipulated by pressure application between the thumb 17 and index and middle fingers 19 and 21 along with relative sliding movement which will transmit such relative sliding movement between the inside surfaces 13 and 15 to cam open the two halves 3 and 5. Opposite return sliding movement will cause the two halves 3 and 5 to close.

The distal portions of inside surfaces 13 and 15 define work engaging surfaces and present considerably more effective surface area for frictional and engaging contact in picking up and holding food than the mere point contacts offered by conventional chopsticks.

Among the advantages that the manipulatable implement of this invention has, compared to conventional eating utensils, are:

(1) It combines the applications of the spoon, fork and, to a limited degree, knife.

(2) It is particularly effective in eating spaghetti and similar foods that are wound onto the end of a fork with the aid of a spoon. Such winding is accomplished by simply holding a few strands of the food with the distal ends 9 of the separate parts 3 and 5, and rolling such parts 3 and 5 over and over using the appropriate motions of the thumb and fingers that has been described.

(3) It requires considerably less skill to operate and use than chopsticks.

(4) It has a larger and more effective surface area for frictional and engaging contact by which to hold food than chopsticks and other utensils.

Figure 3:
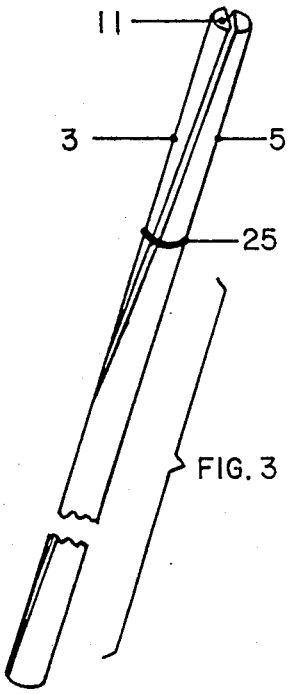
FIG. 3 is a view, broken-away, which shows a modification in the upper region whereby the manipulatable implement is hinged together by a rubber band engaged in a peripheral recess in such upper region.

In the modification shown in FIG. 3, the two halves 3 and 5 are hinged together in their upper region by means of a rubber band 25 engaged in a peripheral recess formed in halves 3 and 5.

The distal portions of the inside surfaces 13 and 15 define the work engaging surfaces which are relatively movable by pressure application between the thumb 17 and index and middle fingers 19 and 21 along with relative sliding movement that transmits such relative sliding movement between the inside surfaces 13 and 15 to cam open the two halves 3 and 5, with opposite return sliding movement causing the two halves 3 and 5 to close. The manipulatable implement when opened spatially occupies little radial area. Hence, the manipulatable implement has ideal use as a hemostat for depth penetration into a surgical incision to clamp off a blood vessel with such surgical procedure requiring little space and not spatially interfering with the main operation itself or requiring a greater surgical incision to accomplish such surgical procedure.

Having thusly described my invention, I claim:

1. A manipulatable implement for use in clamping upon an object, or in picking up small objects, or for use in picking up and holding food, said manipulatable implement comprising a cylinder halved into two separate parts, each of said two separate parts having, in integral, one-piece construction, cooperating means responsive to manipulative pressure applied upon said two separate parts, together with constrained relative sliding movement of said two separate parts, to cam open and close said two separate parts in clamping upon an object, or in picking up small objects, or in picking up and holding food.

2. A manipulatable implement in accordance with claim 1, wherein said means comprises a common division running through the center axis of said cylinder at a constant slope for its entire length.

3. A manipulatable implement in accordance with claim 2, wherein said division running through said center axis of said cylinder spirals therethrough and follows the contour of a double helix.

4. A manipulatable implement in accordance with claim 3, wherein such spiraling division has a rotation of approximately 180 degrees.

5. A manipulatable implement in accordance with claim 1 wherein said cylinder has a upper region having a peripheral recess and said recess receives an elastic member therein in engaged relationship therewith to hinge together said two separate parts of said cylinder.

* * * * *